United States Patent [19]

Roosen

[11] 4,015,541

[45] Apr. 5, 1977

[54] BOGIE DRAFT LINKS

[75] Inventor: Willi Roosen, Baunatal, Germany

[73] Assignee: Rheinstahl AG, Essen, Germany

[22] Filed: July 16, 1975

[21] Appl. No.: 596,568

[30] Foreign Application Priority Data

July 18, 1974 Germany ..... 2434584

[52] U.S. Cl. ..... 105/199 R; 105/200

[51] Int. Cl.[2] ..... B61D 1/14; B61D 3/08; B61D 5/20; B61D 5/50

[58] Field of Search ..... 105/199 R, 200

[56] References Cited

UNITED STATES PATENTS

| | | | |
|---|---|---|---|
| 665,382 | 1/1901 | Carnahan | 105/199 R |
| 688,485 | 12/1901 | Robbins | 105/199 R |
| 3,402,679 | 9/1968 | Christian et al. | 105/200 X |

FOREIGN PATENTS OR APPLICATIONS

| | | | |
|---|---|---|---|
| 310,240 | 9/1973 | Austria | 105/199 R |
| 552,538 | 6/1932 | Germany | 105/199 R |
| 261,798 | 5/1949 | Switzerland | 105/199 R |
| 1,116,012 | 6/1968 | United Kingdom | 105/199 R |

*Primary Examiner*—Robert J. Spar
*Assistant Examiner*—Howard Beltran
*Attorney, Agent, or Firm*—Walter Becker

[57] ABSTRACT

A rail vehicle arrangement in which a load supporting bridge boom has a pair of trucks in spaced relation therebeneath and springs supporting the booms on the trucks. The trucks have no bogie pin connection with the bridge boom and the transmission of pulling and braking loads are transmitted between the bridge boom and the trucks by steering bars in the central plane of the bridge boom swivelly connected at one end to the bridge boom and swivelly connected at the other end to a respective truck.

7 Claims, 5 Drawing Figures

BOGIE DRAFT LINKS

The present invention relates to an arrangement of steering bars for transmitting pulling and braking forces from trucks without bogie pin on rail vehicles, especially locomotives, which arrangement is provided between each truck and the bridge boom with upper structure while each steering bar is on one hand linked outside the wheel base to the truck and on the other hand is linked to the bridge boom, and while the truck is pivotable relative to the bridge carrier also in vertical, longitudinal and transverse planes.

A driving truck for rail vehicles with a bogie-pin-free two or more axle driving truck of the above mentioned type has become known in which each steering bar is linked to the bridge boom along the longitudinal central plane. With this known construction, the two trucks which face each other are with their two steering bars linked to a central support provided on the bridge boom and extend in a horizontal plane and in opposite directions. In view of these steering bars arranged one behind the other in the longitudinal direction of the vehicle, a considerable space is required between the two trucks in view of the angular adjustability of the trucks relative to the bridge boom when passing through curves. This space, however, will when rail vehicles are involved with a plurality of trucks, require an undue length which represents a drawback.

It is, therefore, an object of the present invention to provide an arrangement for a bogie-pin-free truck with a steering bar of the above mentioned type for transmitting pulling and braking forces, by which arrangement a considerably shorter rail vehicles will be made possible while the angular adjustment of the truck relative to the bridge boom will not be affected.

These and other objects and advantages of the invention will appear more clearly from the following specification in connection with the accompanying drawings, in which.

Figures 1, 2, 3:
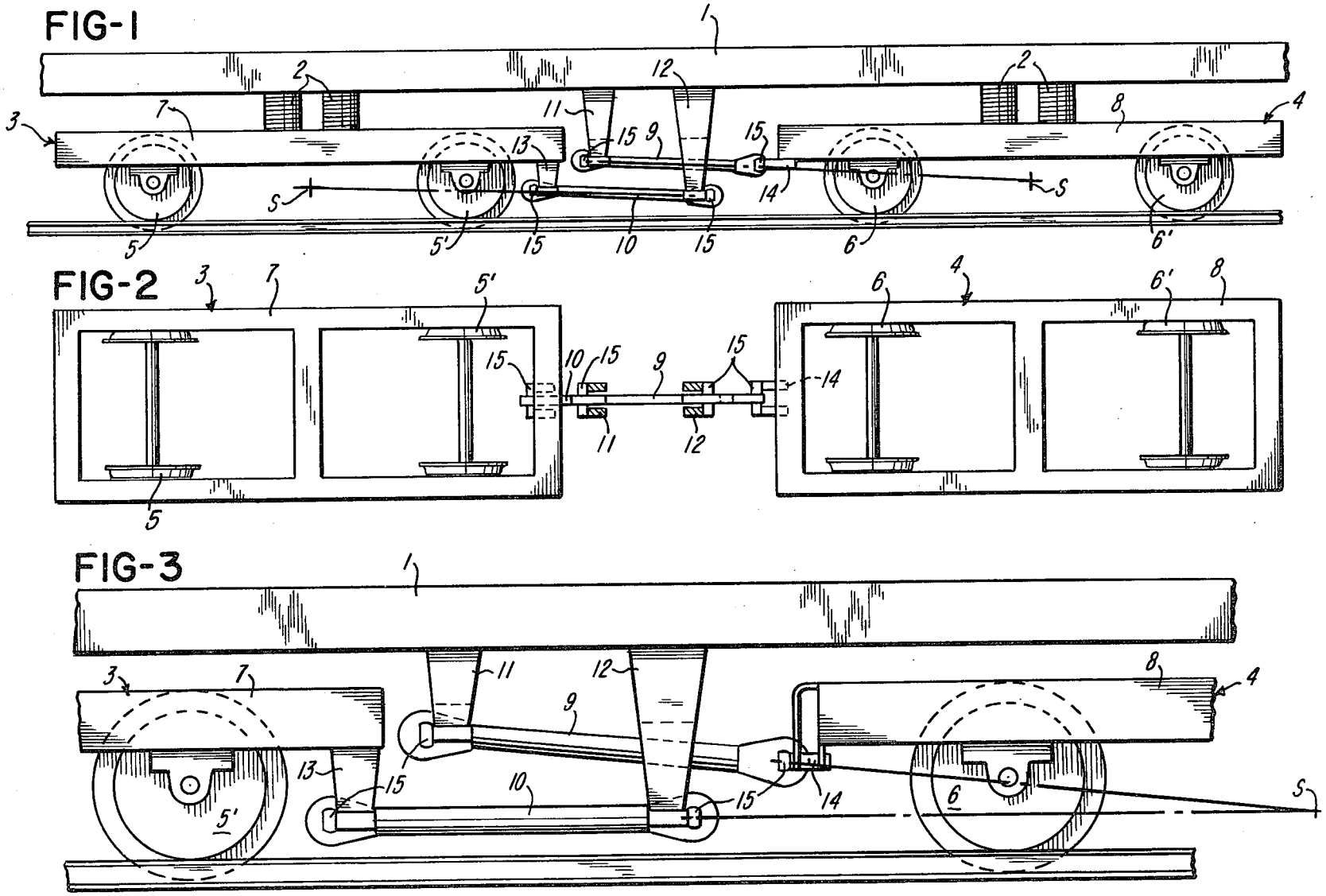
FIG. 1 is a side view of a partially illustrated bridge boom of a rail vehicle with two trucks and illustrates the steering bars which connect the trucks to the bridge boom and which differ from each other in height while being parallel to each other.
FIG.2 is a top view of the showing of FIG. 1 but with the bridge boom removed.
FIG. 3 is a side view of an enlarged portion of FIG. 1 with the steering wheels arranged in a different manner with regard to FIG. 1.
Figure 4:
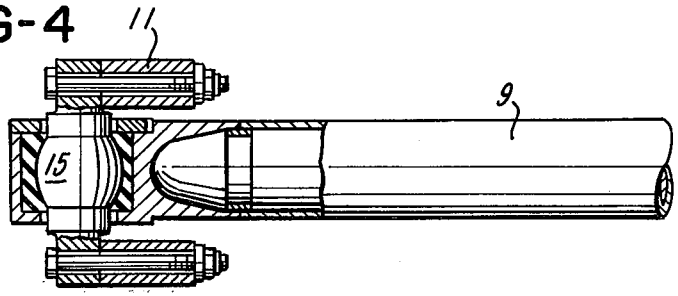
FIG. 4 illustrates on a larger scale than FIGS. 1 to 3 a detail of FIG. 1 and more specifically shows in longitudinal section the pivotal connection of the upper steering bar.

The arrangement according to the present invention is characterized primarily in that with each two serially arranged trucks the steering bars which in a manner known per se are equipped with joints movable in three dimensions are in the longitudinal direction of the vehicle arranged one above the other while said steering bars extend symmetrically to the vertical, longitudinal central plane of the bridge boom up to the columns which outside from the bridge boom extend downwardly up to the columns which extend downwardly from the bridge boom outside the transverse central plane between the two trucks. Due to these steering bars which extend symmetrically with regard to the vertical, longitudinal central plane of the bridge boom up to the columns located outside the transverse central plane, the forces are transferred in a kinetically precise manner. A particular advantage of the invention consists in that in spite of the limited space conditions due to the compacted design, the central region between the two trucks remains free, and will be available for mounting for instance fuel containers, battery boxes and the like.

With one embodiment of the invention, the two steering bars have a parallel distance when viewing in the longitudinal direction of the vehicle.

Another embodiment of the present invention is characterized primarily in that the two steering bars in the longitudinal direction of the vehicle confine an angle with each other while one steering bar is horizontal and the other steering bar is inclined upwardly or downwardly, or both steering bars are inclined. The two steering bars are so arranged that one or both extended longitudinal axes intersect in a point which is located in a vertical plane which extends through the central bogie wheel axle of a for instance three-axle truck or is located in the central vehicle plane of a for instance two-axle truck.

Referring now to the drawings in detail, the drawings partially illustrate a bridge boom 1 of a rail vehicle, which bridge boom is through lateral springs 2 supported in a pendulum-like manner by two likewise only partially illustrated trucks 3 and 4 each having two wheel sets 5,5' and 6,6'. The springs 2 which are arranged between the bridge boom 1 and the truck 3 and 4 are designed as flexicoil springs and rest on the truck frames 7 and 8.

The bridge boom 1 is connected to each truck 3,4 by means of a steering bar 9, 10 which transfers the pull and braking forces.

Each steering bar 9 and 10 has one end linked outside the wheel base to the truck frame 7 and 8 and has its other end linked to a column 11 or 13 three-dimensionally while said column hangs downwardly from the bridge boom 1. That end of the steering bar 9, 10 which is located at the bogie side is by means of an end transverse strut of the bogie frame connected either through a column 13 fastened to the bottom side or a holding means 14 located on the end face side.

For pivotally connecting each of the torsion resistant steering bars 9 and 10 which are subjected to pull and pressure, there are provided joints 15 movable in three dimensions, which includes service-free joint bearings known per se of rubber or synthetic material. The two steering bars 9 and 10 are so journalled that when pivoting the trucks 3 and 4 relative to the bridge boom 1, for instance when passing through curves, the said steering bars 9 and 10 will be able to carry out corresponding pivot movements in the transverse direction. The steering bars 9 and 10 which connect the trucks 3 and 4 with the columns 11 and 12 on the bridge boom 1 and which transmit the pulling and braking forces are in the longitudinal direction of the vehicle arranged one above the other.

According to the embodiment of FIG. 1, the two inclined steering bars 9 and 10 are in the longitudinal direction of the vehicle parallelly spaced from each other.

Figure 5:
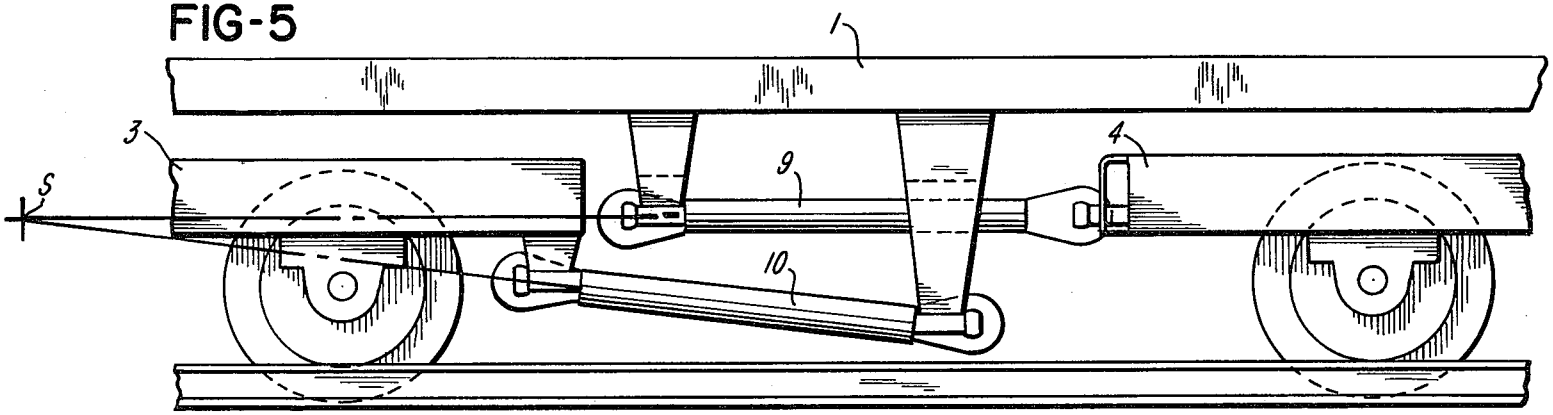
FIG. 5 is a side view similar to that of FIG. 3 but with a still different arrangement of the steering bars.

According to the embodiments of FIGS. 3 and 5, the two steering bars 9 and 10 are so arranged that they confine an angle with each other. The two steering bars 9 and 10 are so arranged that one or both extended longitudinal axes intersect in a point S which is located in a vertical plane extending through the central bogie wheel of a three-axle truck or is located in the central vertical plane of a two-axle truck.

With the relatively short distance of the two trucks 3 and 4 with regard to each other as it is obtained by the specific arrangement of the two steering bars 9 and 10, the transfer of the pulling and braking forces from the trucks 3 and 4 to the bridge boom 1 is effected in a proper manner even though with the pivoted trucks, the power transmission is unsymmetrical.

It is, of course, to be understood that the present invention is, by no means, limited to the specific showing in the drawings but also comprises any modifications within the scope of the appended claims.

What is claimed is :

1. In combination with a rail vehicle having a bridge boom and at least two trucks in longitudinally spaced relation therebeneath and each truck pivotal in a horizontal plane and resiliently supporting the bridge boom, and means for transmitting longitudinal forces both under pulling tension and under braking pressure between said bridge boom and said trucks comprising a longitudinal steering bar extending between the bridge boom and each truck respectively, said bars being disposed one above the other and overlapping each other symmetrically as to be positioned in a central vertical longitudinal plane of the bridge boom between both trucks, first swivel means at one end of each bar connecting the respective bar to the bridge boom and in the region of said bridge boom between said trucks, and second swivel means connecting the other ends of said bars to the center of the adjacent end of a respective one of said trucks.

2. A rail vehicle in combination according to claim 1 in which said bars are disposed in vertically spaced parallel relation to one another.

3. A rail vehicle in combination according to claim 1 in which said bars are disposed in vertically spaced angular relation to one another.

4. A rail vehicle in combination according to claim 1 in which the extension of the longitudinal axis of each said bar intersects the vertical central axis of the respective truck at least when the truck is in a stationary position beneath the bridge boom.

5. A rail vehicle in combination according to claim 1 in which said bars overlap in the longitudinal direction with the bar connected to each truck extending therefrom toward the other truck and being connected to the bridge boom near the adjacent end of the other truck.

6. A rail vehicle in combination according to claim 1 in which each of said swivel means is flexible in all directions in a transverse plane while being rigid in the longitudinal direction.

7. A rail vehicle in combination according to claim 1 which includes bracket means dependent from the bridge boom and supporting said first swivel means, said bars extending generally horizontally between said first and second swivel means.

* * * * *